United States Patent [19]

Kato et al.

[11] Patent Number: 4,561,910

[45] Date of Patent: Dec. 31, 1985

[54] DUAL PHASE-STRUCTURED HOT ROLLED HIGH-TENSILE STRENGTH STEEL SHEET AND A METHOD OF PRODUCING THE SAME

[75] Inventors: Toshiyuki Kato, Chiba; Isao Takahashi, Ichihara; Toshio Irie, Chiba; Yozo Ogawa, Okayama, all of Japan

[73] Assignee: Kawasaki Steel Corporation, Kobe, Japan

[21] Appl. No.: 549,221

[22] Filed: Nov. 7, 1983

Related U.S. Application Data

[63] Continuation of Ser. No. 349,635, Feb. 17, 1982, abandoned.

[30] Foreign Application Priority Data

Feb. 20, 1981 [JP] Japan ..... 56-22879

[51] Int. Cl.[4] ..... C21D 7/14

[52] U.S. Cl. ..... 148/12.4

[58] Field of Search ..... 148/12.4, 12 F

[56] References Cited

U.S. PATENT DOCUMENTS 3,951,696 4/1976 Gondo et al. ..... 148/12 R
4,066,474 1/1978 Uchida et al. ..... 148/157
4,188,241 2/1980 Watanabe et al. ..... 148/12 C
4,314,862 2/1982 Sudo et al. ..... 75/126 P
4,316,753 2/1982 Kaneko et al. ..... 148/12.4

FOREIGN PATENT DOCUMENTS 31123 3/1980 Japan ..... 148/12 F
91934 7/1980 Japan ..... 148/12.4

*Primary Examiner*—Wayland Stallard
*Attorney, Agent, or Firm*—Balogh, Osann, Kramer, Dvorak, Genova & Traub

[57] ABSTRACT

A dual phase-structured hot rolled steel sheet having a composition consisting of 0.03–0.15% by weight of C. 0.6–1.8% by weight of Mn, 0.04–0.2% by weight of P, not more than 0.10% of Al, not more than 0.008% by weight of S, and the remainder being substantially Fe, and having a microstructure consisting of ferrite and martensite dispersed therein, the area fraction of said ferrite being at least 70% and that of said martensite being at least 5% at the section of the steel sheet, has a high tensile strength and a low yield ratio of not higher than 70%, and has excellent formability. The steel sheet can be produced in a simple manner by cooling directly a hot rolled sheet at an ordinary cooling rate without the use of a particular cooling pattern.

3 Claims, 2 Drawing Figures

DUAL PHASE-STRUCTURED HOT ROLLED HIGH-TENSILE STRENGTH STEEL SHEET AND A METHOD OF PRODUCING THE SAME

This application is a continuation of application Ser. No. 349,635 filed Feb. 17, 1982, now abandoned.

BACKGROUND OF THE INVENTION (1) Field of the Invention

The present invention relates to a dual phase-structured hot rolled high-tensile strength steel sheet and a method of producing the same. More particularly the present invention relates to an inexpensive dual phase-structured hot rolled high-tensile strength steel sheet having a low yield ratio, a high tensile strength of about 50–80 kg/mm$^2$ and excellent formability due to the dual phase structure consisting of ferrite phase and a second phase, such as martensite (including remaining austenite) or the like, dispersed in the ferrite phase; and to a method of producing advantageously the high tensile strength steel sheet in a simple manner by relaxing effectively the restriction for controlling the cooling step of a hot rolled sheet after hot rolling.

(2) Description of the Prior Art

There has recently been noticed a dual phase-structured steel sheet having a dual phase structure, which consists of a ferrite phase and a second phase dispersed therein, as a high-tensile strength steel sheet having excellent formability. This steel sheet is low in the yield strength (Y.S.) and high in the tensile strength (T.S.), and hence is low in the yield ratio (Y.R.) represented by (Y.S./T.S.)$\times$100, and is remarkably higher in the elongation (El.) than conventional steel sheets having the same T.S. as that of the dual phase-structured steel sheet. However, this characteristic properties do not appear in all ferritemartensite steels, but appears only when the fraction of ferrite phase is at least 70%, the fraction of a second phase is at least 5%, and further the fractions of pearlite and bainite. In this case, the steel has a low Y.R. of not higher than 70% and is excellent in the formability.

As a method of producing the dual phase-structured steel sheet, there have been known a method, wherein a hot rolled sheet is subjected to a continuous annealing and then cooled; and a method, wherein a hot rolled sheet is directly cooled without after-treatment. In the former method, as heat-treatment must be carried out, and the production cost of the steel sheet is high. Therefore, the latter method has been predominantly carried out recently.

Various methods have been proposed as a method of producing dual phase-structured steel sheet by cooling directly a hot rolled sheet, and these methods are generally classified into two methods. In one of the methods, a hot rolled sheet having a dual phase consisting of $\alpha$ and $\gamma$ phases is coiled as such, and the $\gamma$ phase is transformed into martensite during the cooling step after coiling. In another method, a ferrite.martensite microstructure is formed in a steel sheet during the cooling stage following to hot rolling, and then the steel sheet is coiled.

In the former method, a large amount of alloy element, such as Si, Mn, Cr, Mo and the like, must be added to steel in order to keep stably austenite until the martensite transformation occurs during the cooling step, and therefore the production cost of the dual phase-structured steel sheet is high. On the contrary, in the latter method, the addition amount of alloy elements, such as Si, Mn, Cr and the like, to steel can be decreased, but finishing rolling condition, cooling rate after rolling, cooling pattern and coiling temperature must be strictly controlled in order to obtain the above described ideal microstructure containing at least 70% of ferrite and at least 5% of a second phase. However, the latter method has still such drawback that, even when these conditions are strictly controlled, the mechanical property of the coiled steel is apt to be nonuniform in its length and width directions.

The inventors have investigated the above described drawbacks of conventional technics and made various experiments. As a result, the inventors have found that, in the case where a very inexpensive alloy element of P is used, even when the hot rolling condition is limited to a necessary but minimum condition, a dual phase-structured high-tensile strength steel sheet having a high ferrite fraction, a Y.R. of not higher than 70% and excellent ductility can be very inexpensively obtained by merely directly cooling a hot rolled sheet as such without any particular heat-treatment.

That is, in the latter method, the limitation of finishing rolling temperature and the use of a particular cooling pattern, which is carried out in the cooling step following to the finishing rolling and contains a slow cooling stage, have been considered to be indispensable conditions. For example, Japanese Patent Laid Open Application No. 91,934/80 discloses that a dual phase-structured steel sheet can not be obtained unless the finishing rolling is carried out at a low temperature and a hot rolled sheet is firstly cooled slowly and is then quenched. Contrary to this disclosure, the inventors have found that, when the above described steel contains at least 0.04% of P, even in the case where a finishing rolling is carried out at an ordinary finishing rolling temperature by means of a conventional continuous type hot mill and then the hot rolled sheet is cooled at a cooling rate within the ordinary cooling rate range (10°–200° C./sec), at least 70% of ferrite is formed and at least 5% of a second phase is uniformly dispersed in the ferrite due to the enrichment of C in austenite and to the action of Mn. The inventors have made further investigations and found that Si promotes ferrite transformation and enrichment of C in austenite to form martensite more easily, and Cr stabilizes the stability of austenite to increase the hardenability of martensite, whereby the tensile strength of the resulting hot rolled steel sheet is more increased.

SUMMARY OF THE INVENTION

One of the features of the present invention lies in a dual phase-structured hot rolled high-tensile strength steel sheet having a composition consisting of 0.03–0.15% by weight of C, 0.6–1.8% by weight of Mn, 0.04–0.2% by weight of P, not more than 0.10% by weight of Al, not more than 0.008% by weight of S, and the remainder being substantially Fe; having a microstructure consisting of ferrite and martensite dispersed therein, the area fraction of said ferrite being at least 70% and that of said martensite being at least 5% at the section of the steel sheet; and having a yield ratio of not higher than 70%.

Another feature of the present invention lies in a dual phase-structured hot rolled high-tensile strength steel sheet having a composition consisting of 0.03–0.15% by weight of C, 0.6–1.8% by weight of Mn, 0.04–0.2% by weight of P, not more than 0.10% by weight of Al, not more than 0.008% by weight of S, 0.2–2.0% by weight of a total amount of at least one of Si and Cr, and the remainder being substantially Fe; having a microstructure consisting of ferrite and martensite dispersed therein, the area fraction of said ferrite being at least 70% and that of said martensite being at least 5% at the section of the steel sheet; and having a yield ratio of not higher than 70%.

A further feature of the present invention lies in a method of producing dual phase-structured hot rolled high-tensile strength steel sheets, comprising producing a molten steel having a composition containing 0.3–0.15% by weight of C, 0.6–1.8% by weight of Mn, not more than 0.008% by weight of S, not more than 0.10% by weight of Al and 0.04–0.2% by weight of P; forming the molten steel into a slab by a conventional method; subjecting the slab to a hot rolling under a condition that the heating temperature for the slab is kept to 1,100°–1,250° C., the finishing hot rolling temperature is kept to 780°–900° C., the coiling temperature is kept to not higher than 450° C. and the cooling rate from beginning of cooling following to hot rolling to coiling is kept to 10°–200° C./sec.

DESCRIPTION OF THE PREFERRED EMBODIMENT

In the present invention, the amount of the component elements is limited to the defined range based on the following reason.

C is necessary in an amount of at least 0.03% in order to secure the strength of steel and to form martensite. However, the use of more than 0.15% of C deteriorates noticeably the weldability and ductility of steel. Therefore, the amount of C is limited to 0.03–0.15%. Mn is necessary in an amount of at least 0.6% in order to enhance the stability of austenite and to form finally at least 5% of martensite. However, when more than 1.8% of Mn is used, the ferrite transformation is supressed and the bainite transformation is promoted, and hence it is difficult to form finally at least 70% of ferrite and at least 5% of martensite and to obtain not higher than 70% of Y.R. Therefore, the amount of Mn is limited to 0.6–1.8%.

P is a particularly important element in the present invention. When at least 0.04% of P is used, not only the restrictions in the finishing rolling temperature and in the strict controlling pattern for cooling a hot rolled sheet, which restrictions are necessary in the conventional method of producing dual phase-structured steel sheets having a low content of P, can be eliminated, but also at least 70% of ferrite is finally formed and at least 5% of martensite formed by the enrichment of C in austenite and by the action of Mn is dispersed in the ferrite to lower the yield ratio of the resulting steel sheet.

Figure 1:
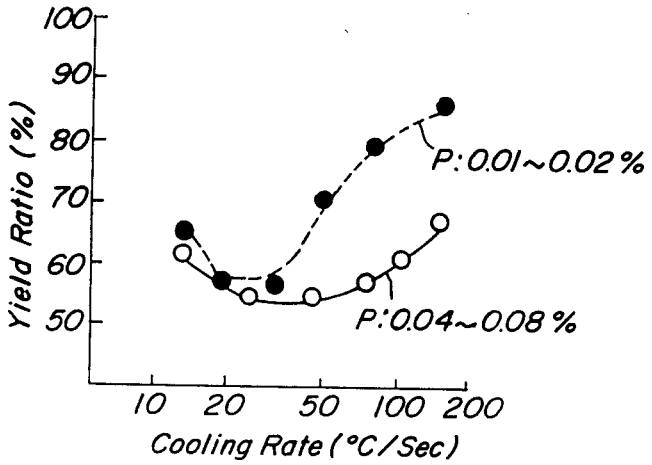
FIG. 1 is a graph illustrating the influence of P upon the relation between the cooling rate after hot rolling and the yield ratio in steel.

FIG. 1 illustrates the Y.R. of a steel sheet produced by a method, wherein a slab of a steel containing 0.05–0.13% of C and 0.8–1.7% of Mn is heated up to 1,100°–1,250° C. and subjected to a hot rolling followed by a finishing rolling at 780°–900° C. by means of a continuous type hot mill, and the resulting hot rolled sheet is cooled at a cooling rate within the range of 10°–200° C./sec and then coiled at a temperature of not higher than 450° C., preferably at a temperature of 400°–100° C. It can be seen from FIG. 1 that, in a steel containing as low as 0.01–0.02% of P, when the cooling rate is high, the resulting steel sheet has a Y.R. of higher than 70%; while in a steel containing at least 0.04% of P, even when the cooling rate is high, the resulting steel sheet has a Y.R. of not higher than 70%. This phenomenon is based on the fact that, in the steel containing at least 0.04% of P, at least 70% of ferrite is formed even at a high cooling rate; while in the steel containing as low as 0.01–0.02% of P, more than 70% of ferrite is not formed and a large amount of bainite is formed. Accordingly at least 0.04% of P is necessary. However, when more than 0.2% of P is used, ferrite is excessively strengthened by the action of P, and the Y.R. becomes higher than 70%. Moreover, the resulting steel sheet is apt to cause brittle fracture at the forming. Therefore, the upper limit of P must be 0.2%.

Al is used as a dioxidation element. The use of at least 0.01% of Al is effective. However, the use of Al in an amount of more than 0.1% results in the increase of inclusions, and is not preferable. Therefore, Al must be used in an amount of not more than 0.1%.

S is used in an amount of not more than 0.008%. Because, when the amount of S exceeds 0.008%, the formability of the resulting steel sheet is very poor due to the presence of elongated inclusions of MnS formed during the hot rolling. Rare earch metals (REM), for example mischmetal, and Ca can form MnS into a spherical shape and improve the formability of the resulting steel sheet. Therefore, REM and Ca can be occasionally used. When the ratio of REM/S and that of Ca/S are less than 2/1 and 1/1 respectively, the effect of REM or Ca does not appear; while, when the ratios are more than 5/1 and 3/1 respectively, large size inclusions are formed to affect adversely the formability of the resulting steel sheet. Therefore, the ratio of REM/S and that of CaS must be within the ranges of 2/1–5/1 and 1/1–3/1, respectively.

In addition to the above described basic elements, Si or Cr alone or in admixture can be contained in the steel of the present invention based on the following reason. Si promotes the ferrite transformation and to enrich C in austenite, whereby martensite transformation is easily caused. Cr stabilizes austenite to increase the hardenability of martensite. These effects can be attained by using at least 0.2% of the total amount of Si or Cr alone or in admixture. However, when the amount exceeds 2%, ferrite is strengthened, and undesirable bainite transformation is promoted. Therefore, Si or C alone or in admixture must be contained in an amount of 0.2–2.0% in total.

A molten steel having the above described composition can be produced by a conventional steel making method, and the molten steel may be made into an ingot and then slabbed, or may be directly formed into a slab by the continuous casting.

The rolling condition in the method of the present invention will be explained hereinafter. The slab-heating temperature is limited to 1,100°–1,250° C. similarly to the case of ordinary hot rolling. The reason is that, when a slab of a steel having a composition defined in the present invention is heated to the above described temperature range and then hot rolled by means of an ordinary continuous type hot mill, a ferrite fraction of at least 70% can be finally obtained without any particular limitation of cooling pattern by merely subjecting a roughly rolled sheet to a finishing rolling at a temperature within the finishing rolling temperature range of 780°-900° C., which temperature range is resulted from the above described slab-heating temperature range of 1,100°-1,250° C., and then cooling the hot rolled sheet at an ordinary cooling rate of 10°-200° C./sec. However, when a slab heated up to a temperature higher than the upper limit of the slab-heating temperature range or lower than the lower limit thereof is rolled, a ferrite fraction of at least 70% in the final product can not be obtained and bainite microstructure is contained in the final product even in the case where the finishing rolling temperature and the cooling rate and cooling pattern following to hot rolling are varied. This fact is probably due to the reason that austenite is present in the form of a mixture of large and small particles at the heating of slab, and this ununiform structure is difficult to be eliminated even by the hot rolling carried out following to the slab-heating. Therefore, the slab-heating temperature is limited to 1,100°-1,250° C.

Figure 2:
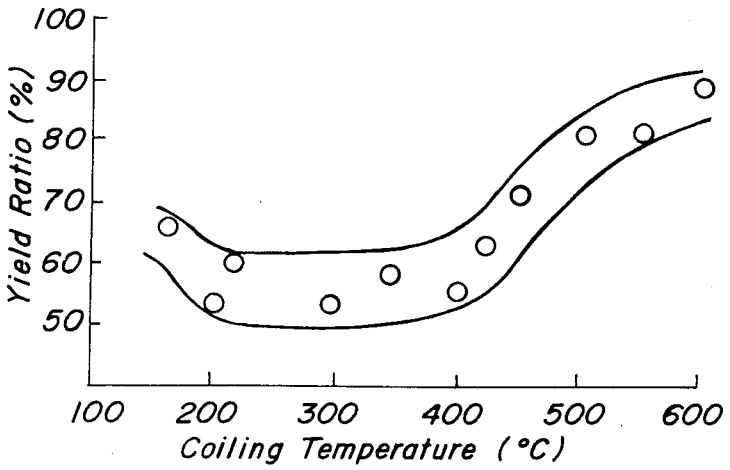
FIG. 2 is a graph illustrating the influence of the coiling temperature upon the yield ratio in steel.

The coiling temperature (C.T.) of the hot rolled sheet is limited to not higher than 450° C. FIG. 2 illustrates a relation between the coiling temperature (C.T.) and the yield ratio (Y.R.) in the case where a slab of 0.08% C-1.3% Mn-0.09% P steel according to the present invention is heated to a temperature of 1,100°-1,250° C., the roughly rolled sheet is subjected to a finishing rolling at a temperature of 780°-900° C. and the hot rolled sheet is cooled at an average cooling rate of 10°-200° C./sec. It can be seen from FIG. 2 that the Y.R. depends substantially upon only C.T. within the above described hot rolling condition, and a Y.R. not higher than 70% can be obtained only when the C.T. is not higher than 450° C. This fact is based on the reason that a C.T. of higher than 450° C. causes pearlite transformation in steel. When the C.T. is not higher than 450° C., C is enriched in austenite portion due to the formation of at least 70% of ferrite in a steel having the composition defined in the present invention before the coiling, and the martensite transformation is caused after or before coiling, in combination with the effect of Mn, whereby the Y.R. is decreased. Therefore, the C.T. is limited to not higher than 450° C.

The following examples are given for the purpose of illustration of this invention and are not intended as limitations thereof.

EXAMPLE 1

A molten steel having a composition shown in the following Table 1, the remainder being substantially Fe, was produced in a converter, and the molten steel was made into an ingot having a weight of 20 tons, and then the ingot was stabbed into a slab having a thickness of 200 mm and a width of 910 mm.

TABLE 1(a)

| Sample No. | Chemical composition (wt. %) | | | | | | | |
|---|---|---|---|---|---|---|---|---|
| | C | Si | Mn | P | S | Al | Cr | Other elements |
| Steel of the present invention | | | | | | | | |
| 1 | 0.09 | 0.01 | 1.35 | 0.041 | 0.002 | 0.035 | 0.01 | REM: 0.009 |
| 2 | 0.10 | 0.01 | 1.55 | 0.102 | 0.003 | 0.041 | 0.01 | REM: 0.009 |
| 3 | 0.05 | 1.02 | 1.20 | 0.087 | 0.002 | 0.038 | 0.01 | Ca: 0.004 |
| 4 | 0.10 | 0.01 | 1.75 | 0.151 | 0.002 | 0.037 | 0.01 | — |
| 5 | 0.08 | 1.03 | 1.63 | 0.084 | 0.001 | 0.041 | 0.01 | — |
| 6 | 0.08 | 0.01 | 1.31 | 0.083 | 0.001 | 0.035 | 1.05 | — |
| 7 | 0.11 | 0.01 | 0.65 | 0.131 | 0.002 | 0.033 | 0.01 | — |
| Comparative steel | | | | | | | | |
| 8 | 0.02 | 0.01 | 1.58 | 0.089 | 0.002 | 0.034 | 0.01 | — |
| 9 | 0.11 | 0.01 | 0.48 | 0.131 | 0.002 | 0.033 | 0.01 | — |
| 10 | 0.08 | 0.01 | 1.93 | 0.039 | 0.003 | 0.042 | 0.01 | — |
| 11 | 0.10 | 0.01 | 1.55 | 0.018 | 0.003 | 0.033 | 0.01 | Ca: 0.007 |
| 12 | 0.08 | 0.01 | 1.58 | 0.209 | 0.001 | 0.034 | 0.01 | — |

TABLE 1(b)

| | Sample No. | Tensile properties (JIS. No. 5) | | | | | Amount of ferrite (%) | Amount of martensite (%) |
|---|---|---|---|---|---|---|---|---|
| | | Y.S. (kg/mm²) | T.S. (kg/mm²) | Y.R. (%) | El. (%) | Yield elongation (%) | | |
| Steel of the present invention | 1 | 30.2 | 53.5 | 56 | 36 | 0 | 88 | 12 |
| | 2 | 33.3 | 62.3 | 53 | 32 | 0 | 85 | 15 |
| | 3 | 31.5 | 60.6 | 52 | 33 | 0 | 87 | 13 |
| | 4 | 39.8 | 66.8 | 60 | 31 | 0 | 78 | 18* |
| | 5 | 38.1 | 70.3 | 54 | 28 | 0 | 75 | 20* |
| | 6 | 31.3 | 61.2 | 51 | 33 | 0 | 86 | 14 |
| | 7 | 34.7 | 55.1 | 63 | 36 | 0 | 86 | 14 |
| Comparative steel | 8 | 39.1 | 47.6 | 82 | 37 | 2.3 | 90 | 0* |
| | 9 | 34.1 | 43.2 | 79 | 38 | 1.5 | 82 | 0* |
| | 10 | 39.7 | 53.1 | 75 | 33 | 0.8 | 42 | 3* |
| | 11 | 36.7 | 48.3 | 76 | 37 | 2.1 | 53 | 0* |
| | 12 | 49.1 | 66.3 | 74 | 27 | 0 | 85 | 12* |

Note: *The remainder is bainite or pearlite.

Each slab was heated up to 1,200° C. and then hot rolled into a coil having a thickness of 2.6 mm by means of a continuous type hot mill consisting of 4 stands of roughing mills and 7 stands of finishing mills, under the following hot rolling condition:

| | |
|---|---|
| Finishing hot rolling temperature: | 800-850° C. |
| Coiling temperature: | 300-380° C. |
| Average cooling rate from beginning of cooling after hot rolling to coiling: | 30-80° C./sec |

Test pieces for JIS No. 5 tensile tests were cut out from the resulting hot rolled coil in a direction perpendicular to the rolling direction, and the tensile tests were carried out. The obtained results are shown in Table 1. It can be seen from Table 1 that steels of sample Nos. 1-7 of the present invention have a yield ratio of 50-65% and are free from the yield elongation. Comparative steels of sample Nos. 8-13, whose C, Mn and P contents are outside the scope of the present invention, have a high yield ratio and cause yield elongation.

It is clear from the comparison of sample Nos. 1-7 with sample Nos. 8-13 that the steel of the present invention is higher than the comparative steel in the elongation when they have the same strength, and the former steel is superior in the ductility to the latter steel.

EXAMPLE 2

A molten steel having a composition of 0.09% C-1.4% Mn-0.09% P-0.035% Al-0.002% S, the remainder being substantially Fe, was produced in a converter of 200 ton capacity, and the molten steel was slabbed into eight slabs of 200 mm thickness, 1,020 mm width and 25 ton weight by means of a continuous casting method. Each slab was hot rolled into a coil having a thickness of 2.9 mm under a rolling condition shown in the following Table 2 by means of a continuous type hot mill consisting of 8 stands of roughing mills and 7 stands of finishing mills.

Table 3 shows the results of tensile tests carried out with respect to test pieces cut out from the coils shown in Table 2.

All the sample steels A-E, which are obtained by a hot rolling of slabs under the rolling condition defined in the present invention, have a Y.R. of not higher than 70% and are free from the yield elongation. However, all the sample steels F, G and H, which are obtained by a hot rolling under a condition outside the range of the present invention, are high in the yield ratio due to the formation of ferrite-pearlite microstructure in the sample steel F and to the formation of ferrite-bainite microstructure in sample steels G and H. Furthermore, sample steels F, G and H are inferior in the El. to sample steels A-E when they have the same T.S.

TABLE 2

| | Sample steel | Slab-heating temperature (°C.) | Finishing hot rolling temperature (°C.) | Water cooling-beginning temperature (°C.) | Average cooling rate from beginning of water cooling to coiling (°C./sec) | Coiling temperature (°C.) |
|---|---|---|---|---|---|---|
| Method of the present invention | A | 1,220 | 860 | 860 | 60 | 340 |
| | B | 1,120 | 810 | 810 | 55 | 320 |
| | C | 1,200 | 800 | 800 | 38 | 420 |
| | D | 1,200 | 840 | 840 | 50 | 280 |
| | E | 1,200 | 840 | 700 | 130 | 350 |
| Comparative method | F | 1,200 | 800 | 800 | 32 | 480 |
| | G | 1,050 | 780 | 780 | 54 | 300 |
| | H | 1,280 | 860 | 860 | 60 | 380 |

TABLE 3

| Sample steel | Y.S. (kg/mm$^2$) | T.S. (kg/mm$^2$) | Y.R. (%) | El. (%) | Yield elongation (%) | Amount of ferrite (%) | Amount of marten site (%) |
|---|---|---|---|---|---|---|---|
| A | 36.1 | 61.2 | 59 | 33 | 0 | 83 | 15* |
| B | 33.3 | 60.2 | 55 | 34 | 0 | 88 | 12 |
| C | 36.2 | 58.7 | 62 | 35 | 0 | 85 | 10* |
| D | 32.4 | 60.0 | 54 | 33 | 0 | 88 | 12 |
| E | 31.8 | 59.1 | 54 | 54 | 0 | 89 | 11 |
| F | 40.5 | 54.2 | 75 | 33 | 2.3 | 85 | 0* |
| G | 41.3 | 57.3 | 72 | 29 | 0 | 62 | 0* |
| H | 48.8 | 62.3 | 78 | 26 | 0 | 53 | 0* |

Note: *The remainder is bainite or pearlite.

As illustrated in the above described examples, according to the present invention, a steel sheet having a proper dual phase structure can be obtained by merely coiling a hot rolled steel sheet as such without any strict restrictions with respect to the finishing hot rolling temperature and to the cooling pattern following to the hot rolling, and the steel sheet is useful as a high-tensile strength steel having a low yield ratio and a high ductility. Particularly, the steel sheet can be produced inexpensively due to the use of inexpensive P as one component, and is very valuable in industry.

Moreover, according to the method of the present invention, the severe restriction in the controlling for the cooling pattern after rolling can be greatly relaxed without accompanying the deterioration of the performance of product, and steel sheets of this kind can be inexpensively produced.

What is claimed is:

1. A method of producing a dual phase-structured hot rolled high-tensile strength steel sheet comprising producing a molten steel having a composition consisting of 0.03-0.15% by weight of C, 0.6-1.8% by weight of Mn, 0.04-0.2% by weight of P, not more than 0.10% by weight of Al, not more than 0.008% by weight of S, and the remainder being substantially Fe, forming the molten steel into a slab by a conventional method, subjecting the slab to a hot rolling under a condition that the heating temperature for the slab is kept to 1,100°-1,250° C., the finishing hot rolling temperature is kept to 800°-900° C., the coiling temperature is kept to not higher than 450° C., and the cooling rate from beginning of cooling following to hot rolling to coiling is kept to 10°-200° C./sec., according to an ordinary cooling pattern by air-cooling or water-cooling, whereby the resulting hot rolled steel sheet having a microstructure consisting of ferrite and martensite dispersed therein, the area fraction of said ferrite being at least 70%, and that of said martensite being at least 5% at the section of the steel sheet; and having a yield ratio of not higher than 70%, a tensile strength of at least 50 kg/mm$^2$, and a yield strength of at least 30 kg/mm$^2$.

2. A method of producing a dual phase-structured hot rolled high-tensile strength steel sheet comprising producing a molten steel having a composition consisting of 0.03-0.15% by weight of C, 0.6-1.8% by weight of Mn, 0.04-0.2% by weight of P, not more than 0.10% by weight of Al, not more than 0.008% by weight of S, 0.2-2.0% by weight of Si, and the remainder being substantially Fe, forming the molten steel into a slab by a conventional method, subjecting the slab to a hot rolling under a condition that the heating temperature for the slab is kept to 1,100°-1,250° C., the finishing hot rolling temperature is kept to 800°–900° C., the coiling temperature is kept to not higher than 450° C., and the cooling rate from beginning of cooling following to hot rolling to coiling is kept to 10°–200° C./sec., according to an ordinary cooling pattern by air-cooling or water-cooling, whereby, the resulting hot rolled steel sheet, having a microstructure consisting of ferrite and martensite dispersed therein, the area fraction of said ferrite being at least 70%, and that of said martensite being at least 5% at that section of the steel sheet; and having a yield ratio of not higher than 70%, a yield strength of at least 30 kg/mm$^2$, and a tensile strength of at least 50 kg/mm$^2$.

3. A method of producing a dual phase-structured hot rolled high-tensile strength steel sheet comprising producing a molten steel having a composition consisting of 0.03–0.15% by weight of C, 0.6–1.8% by weight of Mn, 0.04–0.2% by weight of P, not more than 0.10% by weight of Al, not more than 0.008% by weight of S, 0.2–2.0% by weight of Cr, and the remainder being substantially Fe, forming the molten steel into a slab by a conventional method, subjecting the slab to a hot rolling under a condition that the heating temperature for the slab is kept to 1,100°–1,250° C., the finishing hot rolling temperature is kept to 800°–900° C., the coiling temperature is kept to not higher than 450° C., and the cooling rate from beginning of cooling following to hot rolling to coiling is kept to 10°–200° C./sec., according to an ordinary cooling pattern by air-cooling or water cooling, whereby, the resulting hot rolled steel sheet having a microstructure consisting of ferrite and martensite dispersed therein, the area fraction of said ferrite being at least 70% and that of said martensite being at least 5% at that section of the steel sheet; and having a yield ratio of not higher than 70%, a yield strength of at least 30 kg/mm$^2$ and a tensile strength of at least 50 kg/mm$^2$.

* * * * *